United States Patent [19]

DiMaio

[11] 3,961,517

[45] June 8, 1976

[54] RIVET SETTING TOOL

[75] Inventor: Anthony E. DiMaio, Georgetown, Mass.

[73] Assignee: Marson Fastener Corporation, Chelsea, Mass.

[22] Filed: May 13, 1974

[21] Appl. No.: 469,592

Related U.S. Application Data

[63] Continuation of Ser. No. 189,993, Oct. 18, 1971, abandoned.

[52] U.S. Cl. ..... 72/391; 74/89.17

[51] Int. Cl.[2] ..... B21J 15/34

[58] Field of Search ..... 72/391, 456; 308/237 R, 308/244; 74/89.17, 89.18, 109

[56] References Cited

UNITED STATES PATENTS

| | | | |
|---|---|---|---|
| 82,790 | 10/1868 | Blake | 308/237 R |
| 159,758 | 2/1875 | Herrington | 308/237 R |
| 1,064,612 | 6/1913 | Cline | 308/237 R |
| 2,782,666 | 2/1957 | Reid | 74/89.17 |
| 3,491,578 | 1/1970 | Biermann | 72/391 |
| 3,604,243 | 9/1971 | Mueller | 72/456 |
| 3,637,272 | 1/1972 | Christiansen | 308/237 R |
| 3,646,800 | 3/1972 | Martin | 72/391 |
| 3,782,165 | 1/1974 | Bosch | 72/391 |

*Primary Examiner*—C. W. Lanham
*Assistant Examiner*—Gene P. Crosby
*Attorney, Agent, or Firm*—Pennie & Edmonds

[57] ABSTRACT

A rivet setting tool having rack and pinion gear structure is disclosed. The rack is rectangular in cross-section and bears squared teeth on its upper face. A slideway is provided for movement of the rack and a wear plate is disposed within the slideway. The wear plate includes a base and a pair of upstanding spaced laterally disposed members projecting from the base and a downwardly depending portion at one end of the base. The base and upstanding sides abut the bottom and adjacent sides of the rack. The tool includes a body element having a plurality of spaced pairs of internally disposed bearing support openings. Each of the openings have square sides. Within each pair of adjacent bearing support openings a square-sided bearing is disposed which is also provided with an opening therewithin for receiving a pin.

6 Claims, 8 Drawing Figures

INVENTOR.
Anthony E. DiMaio

BY J. Walter Bach

ATTORNEY

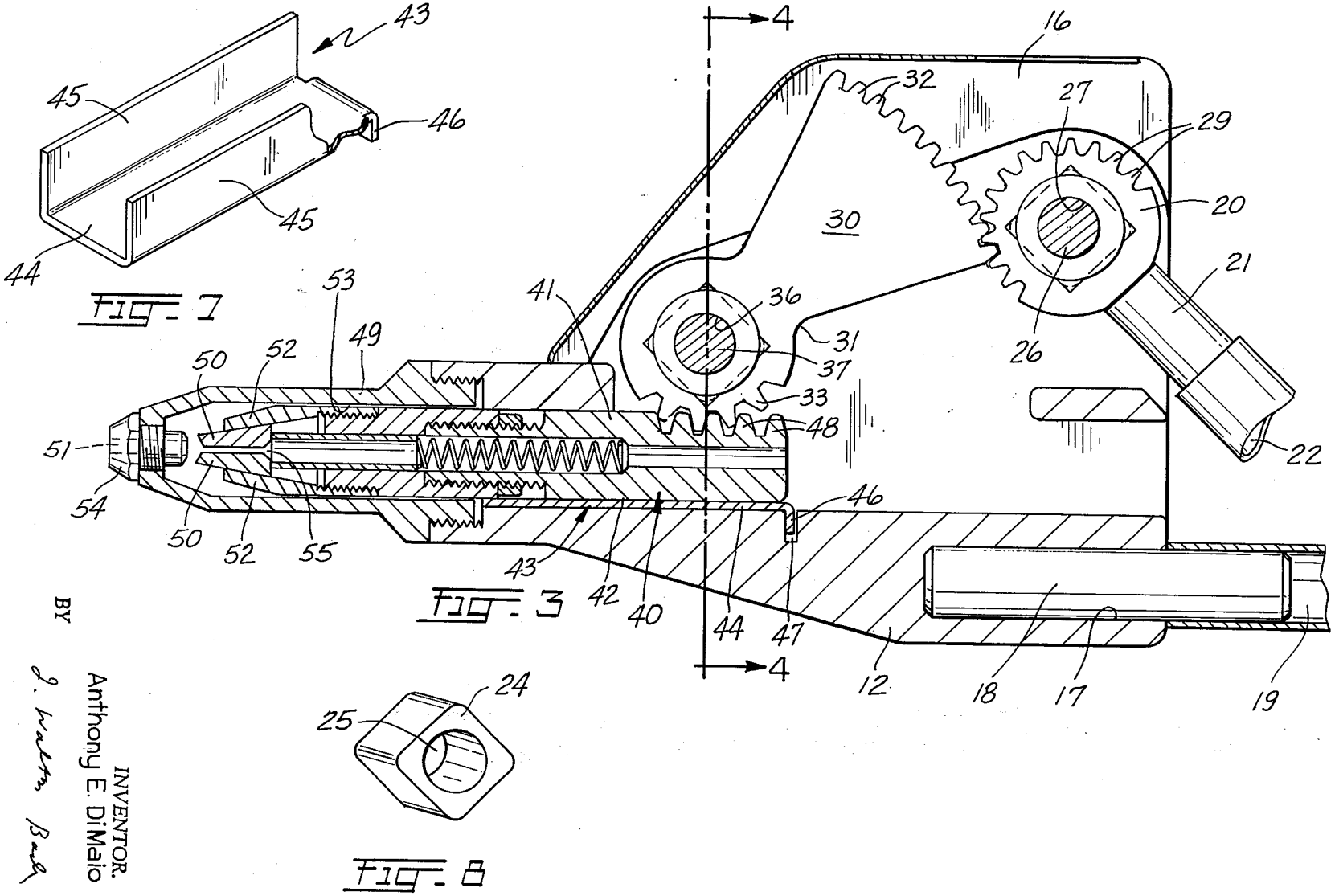
INVENTOR.
Anthony E. DiMaio
BY J. Walter Bach
ATTORNEY

INVENTOR.
Anthony E. DiMaio

BY

J. Walter Bach

ATTORNEY

RIVET SETTING TOOL

DESCRIPTION OF THE INVENTION

This is a continuation of application Ser. No. 189,993, filed Oct. 18, 1971, now abandoned.

This invention relates to an improved rack and pinion gear structure and to a manually operated rivet setting tool for blind rivets utilizing the said construction as an integral part thereof.

The conventional rack and pinion gear consists of a slidable rack portion of rounded cross-section and a coupled pinion gear. The rack, in many cases, is slidably movable. Because of the rounded cross-section of the rack the portion of engagement of the teeth of the rack and the pinion is extremely small. Therefore, particularly when the rack and pinion is used to produce great force multiplication as by being coupled to lever means the parts have a tendency to break or the interlocked teeth will strip. In addition the round configuration of the rack will prevent the utilization of wear plates between the rack and the slideway since the semi-cylindrical form required for such structures is not satisfactory.

I have invented a rack and pinion gear construction wherein the rack is of rectangular (preferably square) cross-section. The teeth upon the rack are located within the top face and can be deeply cut therewithin. A wear plate can be utilized which includes a flat base and a pair of spaced laterally disposed upstanding elements. The base of the wear plate abuts the base of the rack and the adjacent sides of the rack abut the upstanding portions of the wear plate.

The gear construction which I have invented is also most useful in a manually operated rivet setting tool for blind rivets having an eyelet portion and a mandrel portion. Where the structure of the gear mechanism involved is utilized adjacent the co-acting jaws and the actuating means employed therewithin a particularly advantageous tool is produced. In the tool wherein my invention is employed I have also made further improvements to prevent gear stripping. The bearings which are adjacent the pinion of the rack and the gear portion connected to the handle of the tool are made with rectangular sides. These sides are retained within bearing support elements which also have corresponding rectangular sides. These rectangular sides, in the preferred modification, are square.

The construction set forth above produces a foolproof and reliable rivet setting tool which is far superior to those heretofore produced.

The above sets forth a brief description of this invention and the principal objects and advantages thereof. Other objects and advantages of this invention will become apparent to the reader of this specification as this description proceeds.

The invention can be briefly described as follows:

1. The rack and pinion gear structure of this invention comprises, in combination, a slidably movable rack of rectangular (preferably square) cross-section having an upper face, a pair of slides and a lower face. A plurality of spaced teeth are cut into the upper face and mesh with corresponding teeth on the pinion. A wear plate having a base and a pair of spaced lateral sides is optionally disposed beneath the rack with the base of the rack resting on the base of the wear plate and the sides of the wear plate bear against the sides of the rack.

2. The rivet setting tool of the invention has the rack construction of this invention disposed within a rivet control element which projects from one end of the body. Within the rivet control element are also a pair of co-acting jaws and actuating means for the jaws which are coupled to the rack. An intermediate elongated pinion is provided which has an opening therewithin and teeth on opposite ends. The teeth on one end of the pinion mesh with the rack and the pinion is disposed between a pair of bearings having an opening therewithin and rectangular (preferably square) sides. These bearings are in turn retained within bearing support elements having rectangular (preferably square) matching sides. The teeth on the opposite end of the pinion mesh with teeth upon a gear member which also is disposed between a pair of similar bearings to the first named bearings and similar bearing support portions. The gear member is in turn secured to a pivotally movable handle which projects from the body portion. A fixed handle selectively abuttable with the movable handle also projects from the body portion.

The invention will now be further described by reference to the drawings which are made a part of this specification.

FIG. 3 is a longitudinal cross-sectional view of the form of invention shown in FIG. 1 showing the position of the internal parts corresponding to the positions of the handles shown.

FIG. 7 is a perspective view, partly in section, of the wear plate member of this invention.

FIG. 8 is a perspective view of the bearing member of this invention.

Figure 1:
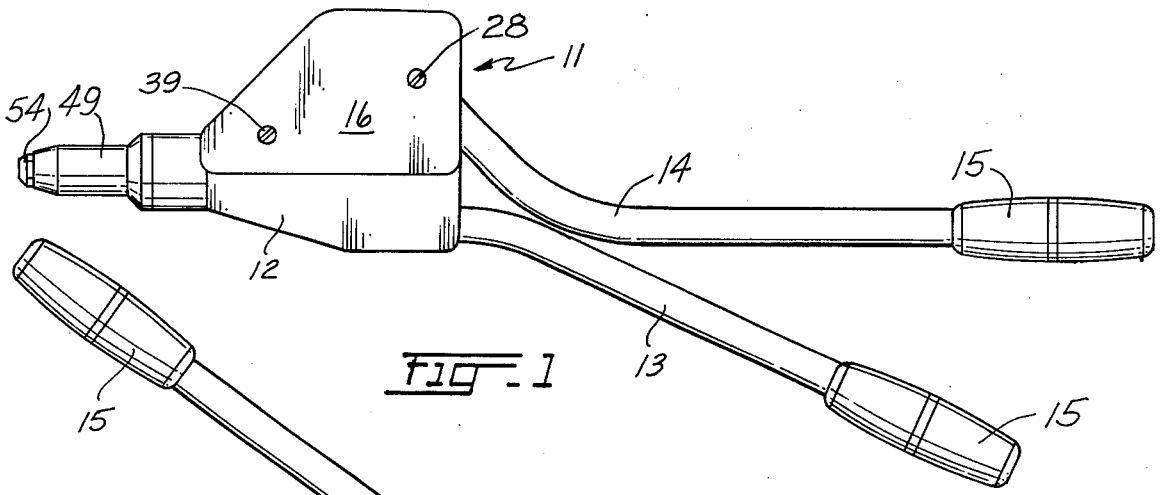
FIG. 1 is a side elevational view of a rivet setting tool made in accordance with this invention. The fixed handle and the movable handle are in abutting relationship with one another.

The invention will now be further described by reference to the specific forms thereof as shown in the accompanying drawings. In this connection, however, the reader is cautioned to note the specific form of this invention, as shown in the specification herein, is for illustrative purposes and for purposes of example only. Various changes and modifications could obviously be made within the spirit and scope of this invention.

A detailed description of this invention will now be given.

The rack and pinion gear structure of this invention includes a rack 40 which is preferably square and includes a top portion 41 and a base 42. A plurality of spaced teeth 48 are cut into top portion 41. Rack 40 is slidably movable within rivet control portion slideway 53. A wear plate 43 is formed with a base 44, a pair of spaced upstanding sides 45 and a downwardly depending end portion 46. Wear plate 43 is retained within recess 47. Base 44 of wear plate 43 abuts base 42 of rack 40 and each side 45 of wear plate 43 abuts a side of the rack.

A pinion 30 is formed with a plurality of teeth 33 at one end and an opening 36 adjacent teeth 33. A pin 37 secures pinion 30 in rotatable relationship. Teeth 33 mesh with the teeth 48 of the rack.

The rack and pinion gear structure of this invention is included within a rivet setting tool for blind rivets 11 as set forth in the accompanying drawings. In this structure the slideway 53 is embodied in a rivet control portion 49 which projects from a body 12. Within rivet control portion 49 are a plurality of co-acting rivet pulling jaws 50 which are connected to jaw actuating means 52 which include a collet case, a spring member and associated structure. The specific rivet pulling jaw structure is conventional in the art and will not be further explained.

A cap member 54 is threadedly secured to the end of rivet control portion 49 and is provided with an opening 51 for the insertion of the mandrel of a blind rivet. The slidable movement of the rack moves the jaw actuating means and thus the jaws.

Pinion 30 is also formed with an additional plurality of teeth 32 and a narrowed intermediate portion 31. The degree of curvature of the periphery of the area occupied by teeth 33 is greater than the degree of curvature of the periphery of the area occupied by teeth 32.

Pinion 30 is disposed within body 12 which also has a plurality of bearing support portions 34 which are disposed upon opposite sides of pinion 30. Portions 34 are formed with rectangular (preferably square) sides. Each of portions 34 are adapted to retain a bearing 35 therewithin which is also formed with square sides and an opening therewithin. The pin 37 passes through the opening within the pinion and the openings within the bearings on opposite sides of the pinion.

Figure 4:
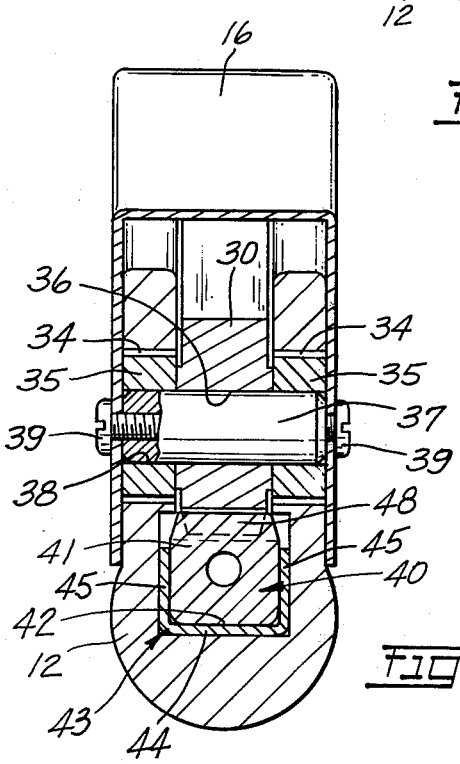
FIG. 4 is a fragmentary cross-sectional view, taken along lines 4—4 of FIG. 3.

A cover member 16 is disposed over body 12. Cover member 16 is secured about body 12 by means of screws 39 which are secured to cover member 16 and to pin 37 (FIG. 4). The cover member is also secured in position by additional screws 28 as will be subsequently explained.

A gear 20 is formed with teeth 29 and an opening 27 therewithin. Teeth 29 are adapted to mesh with teeth 32 of pinion 30. A plurality of bearing support portions 23 are provided within body 12 adjacent gear 20 and on opposite sides. Each of bearing support portions 23 are polygonal-sided (preferably square-sided). The specific structure of a bearing 24 is shown in FIG. 8 and this is also the structure of bearings 35.

A pin 26 passes through aligned openings 25 of a pair of bearings 24 and the opening 27 within gear 20. Cover 16 is also retained in position by screws 28 which are secured to pin 26.

Gear 20 in turn is connected to an arm 21 which in turn is connected to movable handle 14. Handle 14 bears a hollow portion 22 within which arm 21 is disposed.

A fixed handle 13 is also provided having a hollow portion 19. An arm 18 is retained within a recess 17 within body 12 and the projecting portion of arm 18 is secured to the hollow portion 19 of handle 13. The ends of handles 14 and 13 have hollow rubber grips 15 disposed thereupon.

With the foregoing specific description the operation of this invention will now be explained. This operation will be discussed in connection with the rivet setting tool of this invention since the operation of the rack and pinion gear portion of this invention will become clear during such discussion.

Figure 2:
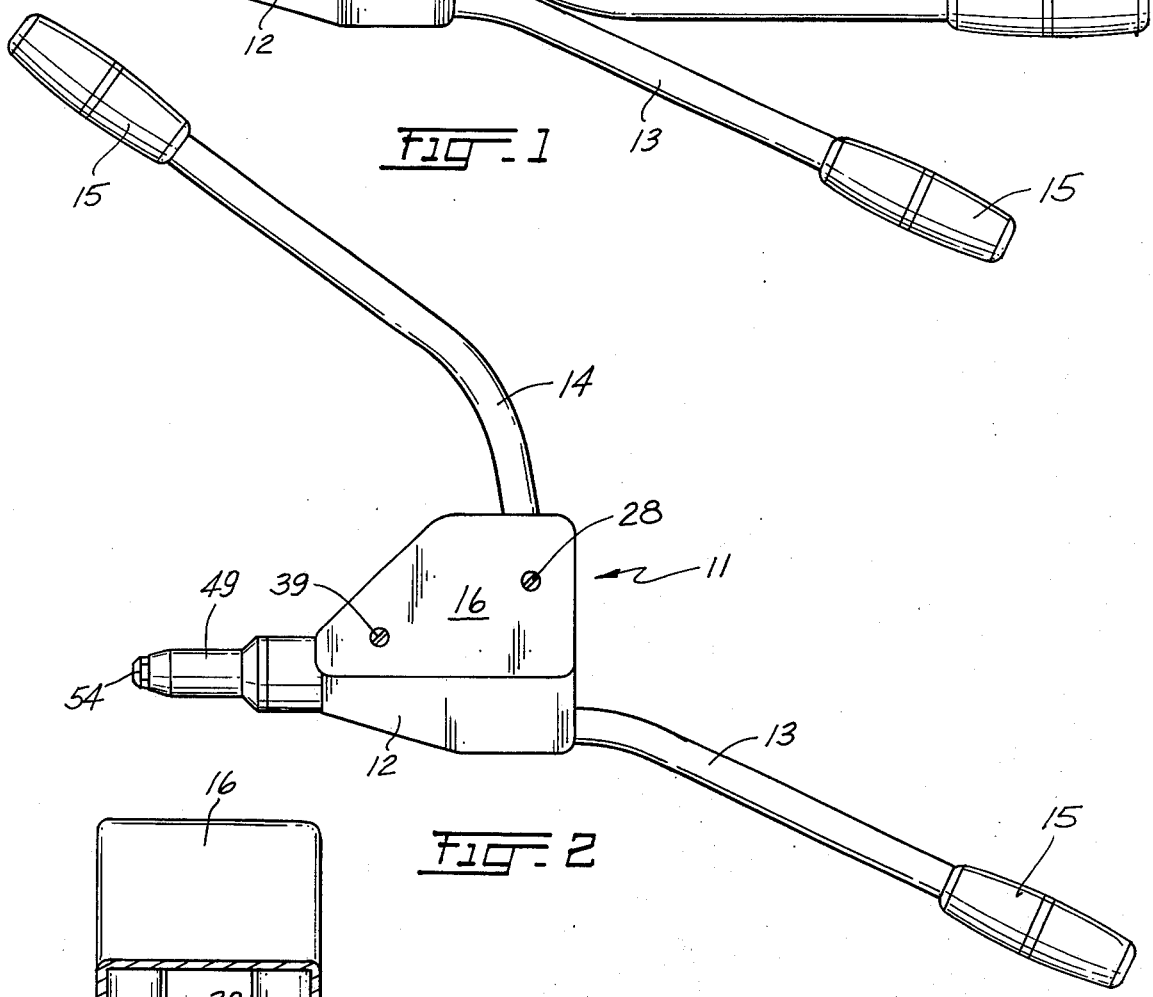
FIG. 2 is a view similar to that of FIG. 1 but showing the position of the handles at their maximum separation distance from one another.
Figures 5, 6:
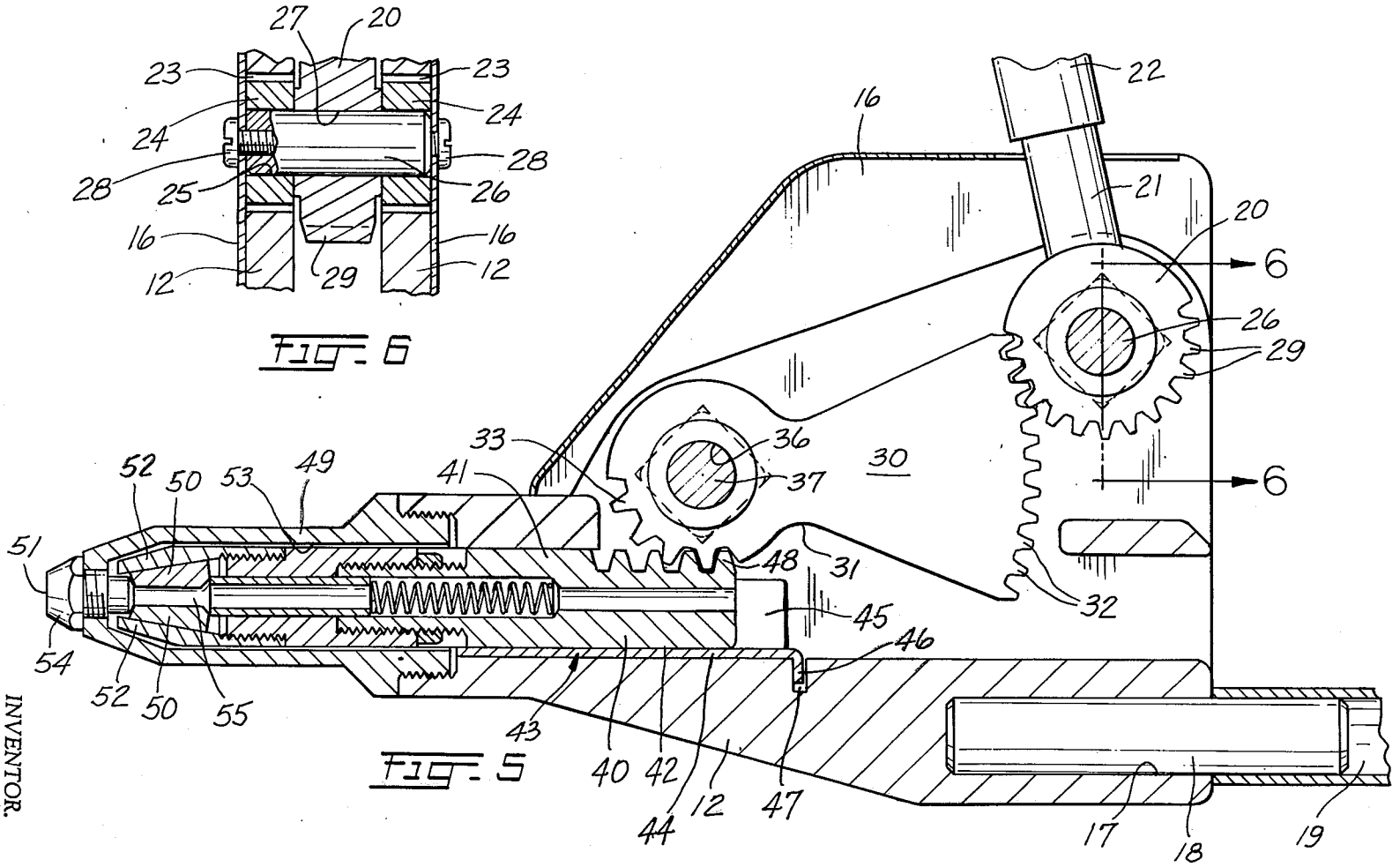
FIG. 5 is a longitudinal cross-sectional view of the form of invention shown in FIG. 2 showing the position of the internal parts corresponding to the positions of the handles shown.
FIG. 6 is a fragmentary cross-sectional view, taken along lines 6—6 of FIG. 5.

The device is readied for operation by placing the handles in the position shown in FIGS. 2 and 5. In this position (See FIG. 5) the jaws 50 are in opened position. The mandrel of a blind rivet can now be inserted into opening 51 and will pass between the jaws and into opening 55. The handle 14 is then pivoted upon pin 26 and the jaws commence an inward and upward movement (See FIG. 3). This movement causes pressure to be exerted on the mandrel of the rivet and will eventually break the stem and upset the eyelet portion thereof to set the same.

It is to be noted that the structure of the tool of this invention provides a great force multiplication since a relatively large distance is traversed by movable handle 14 compared with a relatively small distance traversed by jaws 50. However, this leverage produces a great force on rack 40 and upon the pins 26 and 37. In the conventional construction where rack 40 is round these forces generally will cause the meshing teeth 48–33, and 32–29 to deform or strip. In the construction of this invention the square or rectangular configuration of the rack permits a deeper tooth to be produced and a firmer engagement between teeth 48 and 33.

The conventional bearings utilized in a rivet setting tool have rounded sides. When a large force is produced on these bearings they have a tendency to turn within the bearing retainers and the pins will then score or deform the bearings. In the construction of this invention, since the sides of the bearing retainers and the sides of the bearings are rectangular or square these bearings will not turn and the scoring and deformation of the bearings caused by the conventional structures will not occur.

The foregoing sets forth the manner in which the objects of this invention are achieved.

I claim:

1. A heavy duty manually operated rivet setting tool adapted to set blind rivets which include an eyelet portion and a projecting mandrel portion, said tool comprising, in combination, an elongated body element, a fixed handle secured to one end of said body element and projecting outwardly therefrom, a pivotally movable handle adjacent said fixed handle projecting outwardly from said body element a gear portion secured to said movable handle disposed between first bearing means and provided with an opening in said portion in alignment with openings within said first bearing means, a first pin disposed within the openings, an intermediate elongated pinion member disposed between second bearing means and having teeth at opposite ends thereof and provided with an opening therewithin, one set of teeth of said pinion member being engaged with said gear member, the opening within said pinion member and the openings within said second bearing members being in aligned relationship, a second pin disposed between said aligned openings; a rivet control element projecting outwardly from said body element opposite said handle members, a plurality of co-acting jaws and coupled actuating means therewithin, a polygonal-sided rack slidably movable against the body element to provide a substantial planar load-bearing area between the rack and body element and having teeth thereupon engaged with the opposite set of teeth of said pinion member and at least one of said bearing means including a spaced pair of bearing support elements forming a part of the body element and a bearing member disposed within said support elements, each of said bearing members having a cylindrical chamber therewithin the axis of which chamber is parallel to planes formed by polygonal sides of the bearing with said sides engaging the bearing support element so that the bearing is unable to rotate and each polygonal sided bearing providing substantial load-bearing planar area between the bearing support element and the bearing member through which pressure is applied by the bearing member to the bearing support element.

2. The rivet setting tool of claim 1 in which each of the polygonal bearings are rectangular in shape.

3. The rivet setting tool of claim 1 in which the upper portion of the rack carries square teeth and the rotatable pinion has teeth engageable with said square teeth.

4. A rivet setting tool as described in claim 1 including an elongated wear plate within said elongated body element abutting one side of said rack.

5. A rivet setting tool as described in claim 4 said wear plate including a channel portion, a pair of spaced upstanding members lateral to said channel portion, and a downwardly depending end portion.

6. A heavy duty manually operated rivet setting tool adapted to set blind rivets which include an eyelet portion and a projecting mandrel portion, said tool comprising, in combination, an elongated body element, a fixed handle secured to one end of said body element and projecting outwardly therefrom, a pivotally movable handle adjacent said fixed handle projecting outwardly from said body element, a gear portion secured to said movable handle disposed between first bearing means and provided with an opening in said portion in alignment with openings within said first bearing means, a first pin disposed within the openings, an intermediate elongated pinion member disposed between second bearing means and having teeth at opposite ends thereof and provided with an opening therewithin, one set of teeth of said pinion member being engaged with said gear portion, the opening within said pinion member and the openings within said second bearing members being in aligned relationship, a second pin disposed between said aligned openings; a rivet control element projecting outwardly from said body element opposite said handle members, a plurality of coacting jaws and coupled actuating means therewithin, a polygonal-sided rack slidably movable against the body element to provide a substantial planar load-bearing area between the rack and body element and having teeth thereupon engaged with the opposite set of teeth of said pinion member and an elongated wear plate within said elongated body element abutting one side of said rack, wherein said wear plate include a channel portion, and a pair of spaced upstanding members lateral to said channel portion, and a downwardly depending end portion.

* * * * *